United States Patent [19]

Kasuya

[11] Patent Number: 4,465,580

[45] Date of Patent: Aug. 14, 1984

[54] CATHODE FOR USE IN ELECTROLYSIS

[75] Inventor: Kazuki Kasuya, Chiba, Japan

[73] Assignee: Chlorine Engineers Corp. Ltd., Tokyo, Japan

[21] Appl. No.: 8,812

[22] Filed: Feb. 2, 1979

[30] Foreign Application Priority Data

Feb. 20, 1978 [JP] Japan ..... 53-17689

[51] Int. Cl.[3] ..... C25B 11/00

[52] U.S. Cl. ..... 204/290 R; 204/290 F

[58] Field of Search ..... 204/290 R, 291, 292, 204/43 T, 43 N, 293, 192 F, 192 SF; 427/438; 429/45, 44

[56] References Cited

U.S. PATENT DOCUMENTS

| | | | |
|---|---|---|---|
| 3,061,525 | 10/1962 | Grazen | 204/9 |
| 3,152,972 | 10/1964 | Brown et al. | 204/41 |
| 3,216,919 | 11/1965 | White et al. | 204/258 |
| 3,250,646 | 5/1966 | Hipp | 429/45 |
| 3,409,472 | 11/1968 | Weber et al. | 429/45 |
| 3,415,734 | 12/1968 | Kalhammer | 204/284 |
| 3,441,390 | 4/1969 | Backe et al. | 429/45 X |
| 3,451,914 | 6/1969 | Colman | 204/268 |
| 3,711,385 | 1/1973 | Beer | 204/59 R |
| 4,142,950 | 3/1979 | Creamer et al. | 204/96 |

FOREIGN PATENT DOCUMENTS

| | | | |
|---|---|---|---|
| 744048 | 10/1966 | Canada | 429/45 |
| 264096 | 11/1970 | U.S.S.R. | 204/43 N |

*Primary Examiner*—John F. Niebling

*Attorney, Agent, or Firm*—Sughrue, Mion, Zinn, Macpeak, and Seas

[57] ABSTRACT

A cathode for use in electrolysis comprising (1) a corrosion-resistant electrically conductive substrate; and (2) a coating thereon of (a) nickel or an alloy of nickel, and (b) fine particles of a platinum-group metal, a platinum-group metal oxide or a mixture thereof uniformly dispersed in the nickel or the alloy of nickel, the particles being present in the coating in an amount of about 0.1% to about 50% by weight; and a method for the production thereof.

4 Claims, No Drawings

CATHODE FOR USE IN ELECTROLYSIS

BACKGROUND OF THE INVENTION

1. Field of the Invention

This invention relates to a cathode for use in electrolysis of an aqueous solution and a method for the production thereof. More specifically, it relates to a cathode for use in electrolysis having a low hydrogen evolution potential and sufficient durability suitable for electrolysis of an aqueous solution of an alkali metal halide and to a method for the production thereof.

2. Description of the Prior Art

In recent years, the role of cathodes for use in the electrolysis industry for producing hydrogen, sodium hydroxide, chlorine, sodium chlorate, sodium hypochlorite, etc., by electrolyzing an aqueous solution, such as an aqueous solution of sodium chloride, has been considered to be important as in the case of anodes.

Heretofore, plates, screens or perforated plates of iron or mild steel have been frequently used as cathodes of this kind for use in electrolysis. Iron as a cathodic material has a considerably low hydrogen evolution potential, but various suggestions have been made in recent years to improve the cathodic material. In the present state-of-the-art where the technique of electrolyzing sodium chloride by an ion-exchange membrane method is being employed and in view of the need for saving energy, cathodes having low hydrogen evolution potentials and good durability have been desired so as to lower the electrolysis voltage further.

Various attempts have been made to reduce the hydrogen evolution potential by developing activated cathodes obtained by coating a cathode substrate with various activating materials.

For example, use of means for increasing the surface area of the cathode is described in, e.g., Japanese Patent Publication No. 6611/56 and Japanese Patent Application (OPI) No. 54877/76 which discloses the provision of a microporous coating of Ni on an iron substrate by coating Ni-Zn on the substrate by plating and then leaching out the Zn.

Coating of an alloy such as Ni-Mo [e.g., as disclosed in British Pat. No. 992,350 (corresponding to Japanese Patent Publication No. 9130/65)] and coating of a platinum-group metal, a platinum-group metal oxide or a mixture thereof with another metal oxide (e.g., as disclosed in Japanese Patent Applications (OPI) Nos. 131474/76 and 11178/77) are also known.

These prior methods have not proved to be fully satisfactory. In the method of forming the microporous coating on the substrate, difficulty is encountered with the leaching out of the Zn as a sacrificing metal. Furthermore, since fine pinholes are formed in the coating, the cathode substrate is exposed to the electrolytic solution and the electrode tends to be damaged by corrosion. The coating of an alloy of an iron-type metal and Mo does not fully reduce the hydrogen evolution potential. A cathode have a coating of a platinum-group metal or an oxide thereof exhibits a low hydrogen evolution potential, but the starting materials are expensive. Moreover, the corrosion resistant coating is not entirely satisfactory. In particular, these cathodes have not proved to be completely satisfactory for use in the electrolysis of sodium chloride using an ion-exchange membrane method in which the cathode is exposed to a high-concentration sodium hydroxide solution at a high temperature.

SUMMARY OF THE INVENTION

An object of this invention is to solve the above-described problems of the prior art to provide an activated cathode having a low hydrogen evolution potential and sufficient durability, and to provide a method for the production of the electrode.

The objects of the invention are achieved with a cathode comprising (1) a corrosion-resistant electrically conductive substrate; and (2) a coating of (a) nickel or an alloy of nickel having a low hydrogen evolution potential, and (b) fine particles of a platinum-group metal, a platinum-group metal oxide or a mixture thereof dispersed therein in an amount of about 0.1% to about 50% by weight as a cathode activating material capable of further lowering the hydrogen evolution potential, produced by means of, e.g., plating, flame spraying, etc. thereby to make a cathode.

The cathode for use in electrolysis of this invention comprises (1) the substrate; and (2) nickel or an alloy of nickel and, dispersed and held in the Ni or Ni alloy, fine particles of a cathode activating material comprising at least one of a platinum-group metal, a platinum-group metal oxide or a mixture thereof. As compared with conventional iron cathodes and nickel-plated cathodes, with the cathode of this invention, the hydrogen evolution potential is decreased by at least about 200 to about 300 mV with respect to these prior conventional iron cathodes and nickel-plated cathodes. Furthermore, since the Ni or the Ni alloy has good adhesion to the substrate and satisfactory alkali resistance, the cathode of this invention exhibits superior electrochemical properties and durability.

DETAILED DESCRIPTION OF THE INVENTION

In the cathode for use in electrolysis of this invention, iron, mild steel and Ni can be suitably used as the substrate (1). Other materials having good electrical conductivity and corrosion resistance, such as valve metals, e.g., titanium, zirconium, niobium, hafnium, tantalum, and alloys containing predominantly these metals, or materials obtained by coating the materials described above on other substrates such as aluminum, lead, tin, zinc, alloys (such as stainless steel, bronze, brass, etc.) or the like, can also be used in this invention. The cathode may have any desired shape, such as that of a rod, a plate, a screen or a perforated plate.

The coating covering the substrate comprises Ni or an alloy of Ni, such as Ni-Mo, Ni-W, Ni-Sn or Ni-Zn, preferably Ni-Mo or Ni-W, having a low hydrogen evolution potential, e.g., lower than that of an iron cathode, and sufficient corrosion resistance as a principal component in the coating. A suitable amount of the Ni in the alloy is more about 50% by weight, although this is not critical. Dispersed in the Ni or the Ni alloy are fine particles of a cathode activating material having high electrochemical activity and capable of further reducing the hydrogen evolution potential comprising a platinum-group metal, a platinum-group metal oxide or a mixture thereof. The inclusion of the cathode activating material leads to an improvement in the electrode characteristics.

The cathode activating material can be one or more of platinum-group metals selected from Pt, Ru, Ir, Rh, Pd and Os and oxides of these metals such as $RuO_2$, $IrO_2$, $OsO_2$, PdO, PtO, $PtO_2$, $Rh_2O_3$, $RhO_2$ or the like. Fine powders of a black platinum-group metal, such as platinum black or ruthenium black, are preferred since they exhibit an especially low hydrogen evolution potential. However, platinum-group metal oxides, such as ruthenium oxide, even when used alone, fully produce the desired effect. A mixture of a platinum-group metal and an oxide thereof may also be in the coating. Other materials, such as nickel oxide, valve metals (Ti, Ta, Nb, Zr, etc.) and oxides thereof, etc., can, of course, be incorporated in the coating in an amount of up to about 50% by weight so long as they do not depart from the objective and scope of the invention.

Desirably, the cathode activating material is present in the form of fine particles so that the material can be coated as dispersed uniformly in the Ni or the Ni alloy. The particle diameter of the cathode activating material is not particularly limited, and particle diameters smaller than about 150 microns are suitable. The preferred particle diameter is smaller than about 75 microns.

The cathode activating material in the coating layer can fully reduce the hydrogen evolution potential if the cathode activating material is present in an amount of at least about 0.1% by weight. On the other hand, when the amount of the cathode activating material exceeds about 50% by weight, the corrosion resistance of the cathode decreases and the cost of the cathode becomes high. Accordingly, a suitable amount of the activating material is about 0.1% to about 50% by weight, preferably about 1 to about 10% by weight.

Better results can be obtained with larger thicknesses of the coating layer. However, considering economy, a suitable thickness of the coating layer is about 1 to 20 microns, with more generally coating thicknesses in ordinary use of 5 to 10 microns sufficing.

The coating (2) can be formed on the substrate (1) by any methods which provide the coating of Ni or the Ni alloy and the fine particles of a platinum-group metal and/or an oxide thereof on the substrate with good adhesion. For example, known methods such as electroplating, electroless plating, thermal decomposition, heat fusion, flame or plasma spray, and vacuum deposition can be employed. The electroplating, method is especially preferred considering the shape of the cathode, the ease of forming the coating, economy, etc.

According to the electroplating method, the cathode activating platinum-group metal and/or the oxide thereof is suspended in the form of fine particles in a nickel or nickel alloy plating bath, and the suspension is electroplated on a substrate serving as a cathode. Thus, the cathode coating of the cathode activating material uniformly dispersed in the Ni or the Ni alloy can be easily formed.

An electrode comprising an iron or iron substrate (1), a compact inner layer (2) of $Fe_3O_4$ and an activating nickel coating (3), which coating (3) can be produced using the techniques described herein, and is described in copending application Ser. No. 8,813, filed Feb. 2, 1979, filed simultaneously herewith.

The present invention as described hereinabove has numerous advantages, some of which are described below.

(1) The activated cathode of this invention exhibits a hydrogen evolution potential about 200–300 mV or more lower than that of conventional mild steel cathodes and nickel-plated cathodes, and the electrolysis voltage can be correspondingly reduced in an electrolysis operation. Thus, the cost of power can be considerably curtailed.

(2) The coating of the activated cathode of this invention comprises principally Ni or an Ni alloy having superior corrosion resistance, and the adhesion of the coating to the substrate is firm. In addition, since the cathode activating material is dispersed uniformly as fine particles in the Ni or the Ni alloy, it is firmly held by the coating layer. Accordingly, the activated cathode of this invention has the same durability as conventional nickel-coated cathodes and can be used as cathodes for various electrolytic processes. The cathode of this invention is especially suitable as a cathode for electrolyzing sodium chloride using an ion-exchange membrane method.

(3) The cost of production of the cathode of this invention can be reduced because the major portion of the coating is Ni or an alloy thereof and the amount of the platinum-group metal or the platinum-group metal oxide is small.

(4) Cathode coatings suitable for particular purposes and uses can be easily formed because the composition of the active material in the coating can be freely selected.

The following examples are given to illustrate the present invention in more detail. It should be understood that the invention is not to be construed as being limited to these specific examples. Unless otherwise indicated herein, all parts, percents, ratios and the like are by weight.

EXAMPLE 1

The surface of a mild steel plate, 3 mm in thickness, was blasted using No. 30 alumina shot to remove rust on the surface and simultaneously to roughen the surface. The plate was then degreased with acetone and washed with a 10% aqueous solution of hydrochloric acid for 10 minutes.

Using the treated plate as a substrate, electroplating was performed from a hydrochloric acid bath under the following conditions to produce an electrode coated with a nickel-plated layer with a fine powder of ruthenium oxide uniformly dispersed in the nickel.

| | |
|---|---|
| Composition Of Bath | |
| Nickel Chloride | 220 g/liter |
| Boric Acid | 30 g/liter |
| Ruthenium Oxide Powder | 1 g/liter |
| Plating Conditions | |
| Temperature | 70° C. |
| Current Density | 5 A/dm$^2$ DC |
| Plating Time | 30 minutes |

The ruthenium oxide used had been prepared by adding 5 cc of a 30% aqueous solution of hydrogen peroxide and 20 cc of a 20% aqueous solution of hydrochloric acid to 1 g of ruthenium chloride, heating the resulting solution while flowing air therethrough at 600° C. for 2 hours to form ruthenium oxide, and pulverizing the oxide to a size smaller than 75 microns in an agate mortar.

The thickness of the plated layer of the resulting cathode was about 30 microns. Fluorescent X-ray analysis of the coating showed that the ruthenium oxide content thereof was 2.0%.

The hydrogen evolution potential of the resulting cathode was measured and compared with that of a mild steel plate.

The hydrogen evolution potential was measured using a mercury oxide electrode as a reference electrode and a nickel plate as an anode in a 10% aqueous solution of sodium hydroxide at 80° C. The hydrogen evolution potential was found to be −0.98 V at a current density of 20 A/dm$^2$, which was 240 mV lower than that of the mild steel plate.

The electrode obtained was used as a cathode in a continuous electrolysis in a 30% aqueous solution of sodium hydroxide at 80° C. at a current density of 100 A/dm$^2$. It was found that, even after electrolysis for 3,000 hours, no appreciable change was noted on the surface of the electrode. The cathode exhibited sufficient durability and the hydrogen evolution potential was stable.

EXAMPLE 2

In the same manner as in Example 1, a substrate of mild steel and a ruthenium oxide powder were prepared. By electroplating from a sulfuric acid bath under the conditions set forth below, a nickel-plated layer of nickel and a fine powder of ruthenium oxide dispersed in the nickel was coated on the substrate to form an electrode.

| | |
|---|---|
| Composition Of Bath | |
| Nickel Sulfate (hexahydrate) | 240 g/liter |
| Nickel Chloride | 45 g/liter |
| Boric Acid | 30 g/liter |
| Ruthenium Oxide Powder | 1 g/liter |
| Plating Conditions | |
| Temperature | 70° C. |
| Current Density | 5.0 A/dm$^2$ DC |
| Plating Time | 30 minutes |

The thickness of the coating of the resulting electrode was about 40 microns, and the amount of ruthenium oxide in the coating was 1.7%.

The surface condition of the coating was examined. It was found that the surface unevenness of the coating was considerably less than with the coating obtained in Example 1.

EXAMPLE 3

A mild steel substrate was produced in the same manner as in Example 1. By electroplating under the conditions shown below, a nickel-plated layer composed of nickel and a fine powder of platinum black dispersed in the nickel was formed on the substrate to form an electrode.

The platinum black used had been prepared by placing two platinum plates as an electrode in a 30% aqueous solution of sulfuric acid, electrolyzing the solution at a current density of 2 A/dm$^2$ while varying the direction of the flow of electric current every 2 minutes, collecting the black precipitate that settled on the bottom of the electrolytic cell, and washing and drying the precipitate.

| | |
|---|---|
| Composition Of Bath | |
| Nickel Chloride | 220 g/liter |
| Boric Acid | 30 g/liter |
| Platinum Black | 1 g/liter |
| Plating Conditions | |
| Temperature | 70° C. |
| Current Density | 5 A/dm$^2$ DC |
| Plating Time | 30 minutes |

The plating bath was stirred with a magnetic stirrer.

EXAMPLE 4

A mild steel substrate was produced in the same manner as in Example 1, and a nickel-plated layer of nickel and a mixture of fine powders of ruthenium black and iridium oxide dispersed uniformly in the nickel was formed on the substrate by electroplating under the conditions shown below. Thus, an electrode was produced. The ruthenium black had been prepared using the method of making platinum black described in Example 3, and the iridium oxide had been prepared using the method of preparing ruthenium oxide described in Example 1.

| | |
|---|---|
| Composition Of Bath | |
| Nickel Chloride | 220 g/liter |
| Boric Acid | 30 g/liter |
| Ruthenium Black | 0.5 g/liter |
| Iridium Oxide | 0.5 g/liter |
| Plating Conditions | |
| Temperature | 70° C. |
| Current Density | 5 A/dm$^2$ DC |
| Plating Time | 30 minutes |

The plating bath was stirred with a magnetic stirrer.

The properties of the cathodes produced in these Examples were measured, and the results obtained are shown in Table 1 below together with those of cathodes for comparison.

TABLE 1

| | Electrode | Hydrogen Evolution Potential [V(vs.NHE)] | Condition After 3,000-Hour Electrolysis |
|---|---|---|---|
| Comparison | Mild steel | −1.22 | A black precipitate of Fe + $Fe_3O_4$ formed on the surface |
| Comparison | Nickel-plated cathode | −1.13 to −1.39 | No change |
| Example 1 | Ni-Ruthenium Oxide | −0.98 | No change |
| Example 2 | Ni-Ruthenium Oxide | −1.02 | No change |
| Example 3 | Ni-Platinum Black | −0.96 | No change |
| Example 4 | Ni-Ruthenium Black/ Iridium Oxide | −0.97 | Slightly consumed |

It can be seen from the results in Table 1 that the cathodes in accordance with this invention have a far lower hydrogen evolution potential (by about 200–300 mV) than the conventional mild steel cathode and nickel-plated cathode, exhibit sufficient durability as an electrolytic cathode and have other superior properties.

While the invention has been described in detail and with respect to specific emodiments thereof, it will be apparent to one skilled in the art that various changes and modifications can be made therein without departing from the spirit and scope thereof.

What is claimed is:

1. A cathode for use in electrolysis comprising:

(1) a corrosion-resistant electrically conductive substrate; and (2) a non-porous coating formed thereon, said coating comprising (a) Ni or an Ni alloy and (b) fine particles of a cathode activating material comprising at least one platinum-group metal oxide selected from the group consisting of Pt, Ru, Ir, Rh, Pd and Os oxides, uniformly dispersed in said Ni or Ni alloy (a), said particles having a particle diameter of about 150 microns or smaller and being present in an amount of about 0.1% to about 50% by weight.

2. The cathode of claim 1, wherein the cathode activating material is at least one platinum-group metal and at least one platinum-group metal oxide.

3. The cathode of claim 1 or 2, wherein the coating (2) on the substrate (1) has a thickness of about 1 to about 20 microns.

4. The cathode of claim 1 or 2, wherein the amount of the cathode activating material in the coating (2) is about 1 to about 10% by weight.

* * * * *